US005120937A

United States Patent [19]

Lyga

[11] Patent Number: 5,120,937

[45] Date of Patent: Jun. 9, 1992

[54] LOCKING DEVICE FOR REMOVABLE POSTAGE METER HAVING IMPROVED DRIVER COUPLING

[75] Inventor: Thomas M. Lyga, Torrington, Conn.

[73] Assignee: Pitney Bowes Inc., Stamford, Conn.

[21] Appl. No.: 690,477

[22] Filed: Apr. 24, 1991

[51] Int. Cl.[5] ..... G07G 1/00

[52] U.S. Cl. ..... 235/101

[58] Field of Search ..... 235/101; 101/91, 228, 101/235

[56] References Cited

U.S. PATENT DOCUMENTS 4,922,085 5/1990 Dannatt et al. ..... 235/101

*Primary Examiner*—L. T. Hix
*Assistant Examiner*—Eddie C. Lee
*Attorney, Agent, or Firm*—Charles G. Parks, Jr.; David E. Pitchenik; Melvin J. Scolnick

[57] ABSTRACT

The improved coupler in combination with a mailing machine base having a postage meter base. A postage meter is insertable and removable from a receptacle. The receptacle is mounted within a base and includes a lock engagement assembly for locking the postage meter in the receptacle. The mailing machine also includes a tape feed assembly having a first drive assembly for positioning the tape feed assembly to a first position and a second position and a second drive assembly for motivating the tape feed assembly. The coupler includes a link coupled to the feed assembly at one end for translating lateral displacement of the feed assembly to rotational displacement of a cam surface formed on the other end of the link. A following lever rides along the cam surface and causes the lock engagement assembly to be coupled to the second drive assembly only when the feed assembly in the first position.

2 Claims, 3 Drawing Sheets

LOCKING DEVICE FOR REMOVABLE POSTAGE METER HAVING IMPROVED DRIVER COUPLING

RELATED APPLICATIONS

This patent application relates to a removable postage meter and security devices therefor as described in U.S. Pat. No. 5,049,727, filed Dec. 28, 1988 and U.S. patent application Ser. No. 607,322, filed Oct. 31, 1990.

BACKGROUND OF THE INVENTION

The present invention relates to postage meters, more particularly, flat-bed printing meters insertable in a mailing machine.

In a specific embodiment of an electronic postage meter of the flat-bed printing type, the postage meter comprises a housing, a printing device disposed in the housing, an aperture in the housing exposing the printing device to the exterior of the housing, a cover for the aperture, means mounting the cover to the postage meter for movement of the cover from a closed position in which the cover is disposed at the aperture denying access to the printing device, and an open position in which the cover is disposed away from the aperture. The cover is structured to prevent access to the printing device when the cover is in the closed position and to permit access to the printing device when the cover is in the open position, and the receptacle includes first engaging means for engaging the cover in a predetermined position of the postage meter, and driving means for driving the first engaging means to move the cover between the closed and open positions thereof.

A receptacle or base for receiving the postage meter comprises a first receptacle part (e.g., a meter pocket) and second receptacle part (e.g., a locking device) and means coupling the first and second receptacle parts together such that the first receptacle part is pivotal between a first position thereof in which the first receptacle part forms an angle with the second receptacle part and a second position thereof in which the first receptacle part is within the second receptacle part. The first receptacle part includes means for receiving a first end of the postage meter therein when the first receptacle part is in the first position, and the second receptacle part includes second engaging means for engaging a second end of the postage meter therein when the first receptacle part is in its second position within the receptacle part.

The base also includes a tape feed mechanism with a tape drive assembly for positioning tape for the selective printing of a postage indicia thereon. The tape drive assembly is also adapted to drive the meter cover engaging means and thereby eliminating the need for a separate, meter cover engaging drive. The base includes a tape track and aligned cam rod. A tape feed assembly is slidably mounted to and supported by the tape track and cam rod such that rotation of a tape track motor causes the tape assembly to be positionable from a home position to a second position. The tape assembly includes a drive gear assembly for causing tape to be fed into the tape assembly which is only brought into engagement with the second motor when the tape feed assembly is in the home position. When the tape feed carriage assembly is driven by the first motor and caused to assume its second position, the second motor is now available to drive a meter locking device, which in the preferred embodiment is represented by the meter cover engaging means. Coupling of the second motor to the meter cover engaging means was facilitated by a striker supported in a cantilevered manner off of tape feed carriage assembly. It has been observed that the striker arrangement consumed a substantial amount of power and caused the tape carriage to torsionally load its support structure.

SUMMARY OF THE INVENTION

It is an objective of the present invention to present a coupling-uncoupling arrangement which reduces the load demand on the first drive motor and eliminates torsion on the tape carriage.

The drive gear assembly includes a hub gear which is mounted to shaft shaft. The shaft has fixably mounted at its other end a spool which is in driving communication, such as by endless belts, with meter cover engaging means. The hub gear is mounted such that when the tape feed assembly is in the second position, the hub gear is engaged to the second drive motor for displacing the meter cover engaging means. However, when the tape feed assembly is in the home position, the hub gear is disassociated or decoupled from the drive gear assembly and the second motor is used to feed tape through the tape feed assembly.

A link is slidably mounted at one end to the tape carriage support structure. The other end has a formed eccentric and is pivotally mounted about a point at the eccentric end such that displacement of the tape carriage support structure causes the link to pivot. Pivotal motion of the link causes the eccentric to decouple the hub gear.

FIGS. *3a* and *3b* is a side view partially in section of the portion of the postage meter and locking device which locks the postage meter in a predetermined position, showing the locking device uncoupled.

DETAILED DESCRIPTION OF THE INVENTION

Figure 1:
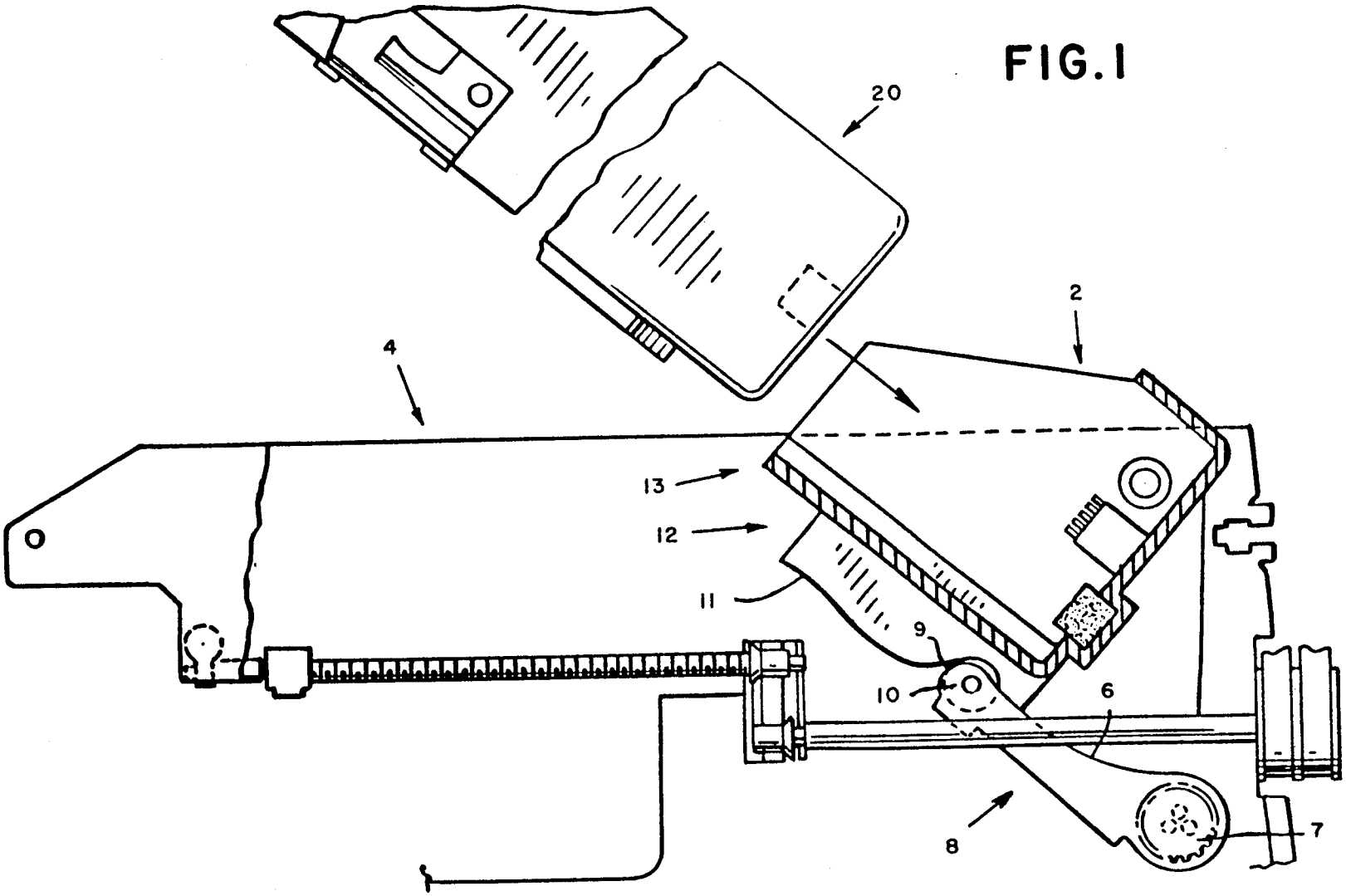
FIG. 1 is a side view, partially in section, of the postage meter and meter pocket and a locking device.

Referring to FIG. 1, meter pocket 2 is mounted to locking device 4 by a counterbalance mechanism 8 which includes counterbalance arm 6 fixed to torsion bar 7. A detailed description of the counterbalance mechanism 8 and other cooperative mechanisms with the present invention are presented in U.S. patent application Ser. No. 607,322, filed Oct. 31, 1990, entitled IMPROVED LOCKING DEVICE FOR REMOVABLE POSTAGE METER", herein incorporated by reference. Generally, pivoting of counterbalance arm 6 torques the torsion bar 7 which resists pivoting and urges counterbalance arm 6 back to its rest position depicted. Roller 9 is rotatable mounted to end 10 of counterbalance arm 6 to ride along cam surface 11 of counterbalance cam 12 attached to the bottom of a meter pocket 13. Postage meter 20 is inserted into meter pocket 2 and postage 20 and meter pocket 2 are then pivoted against the force of counterbalance torsion bar 7 to lower postage meter 20 into locking device 4. Postage meter 20 and meter pocket 2 are mechanically locked in locking device 4 by latching arrangement (not here shown, but is fully described and disclosed in U.S. patent application Ser. No. 291,462 filed Dec. 28, 1988 incorporated by reference herein) urged upwardly by the action of torsion bar 7.

Figure 2:
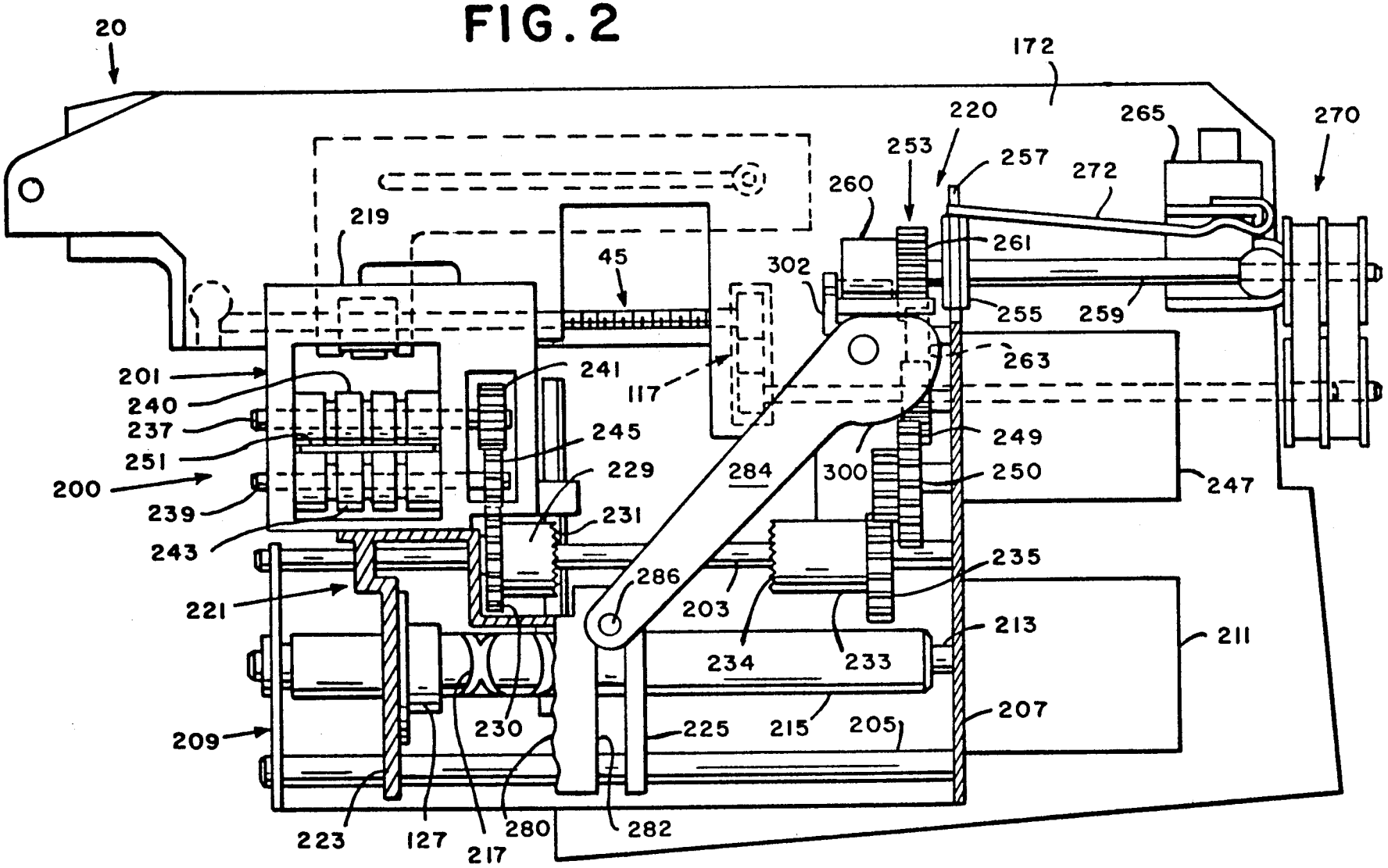
FIG. 2 is a side view, partially in section and partly broken away, of the postage meter, meter pocket and locking device.
Figures 3A, 3B:
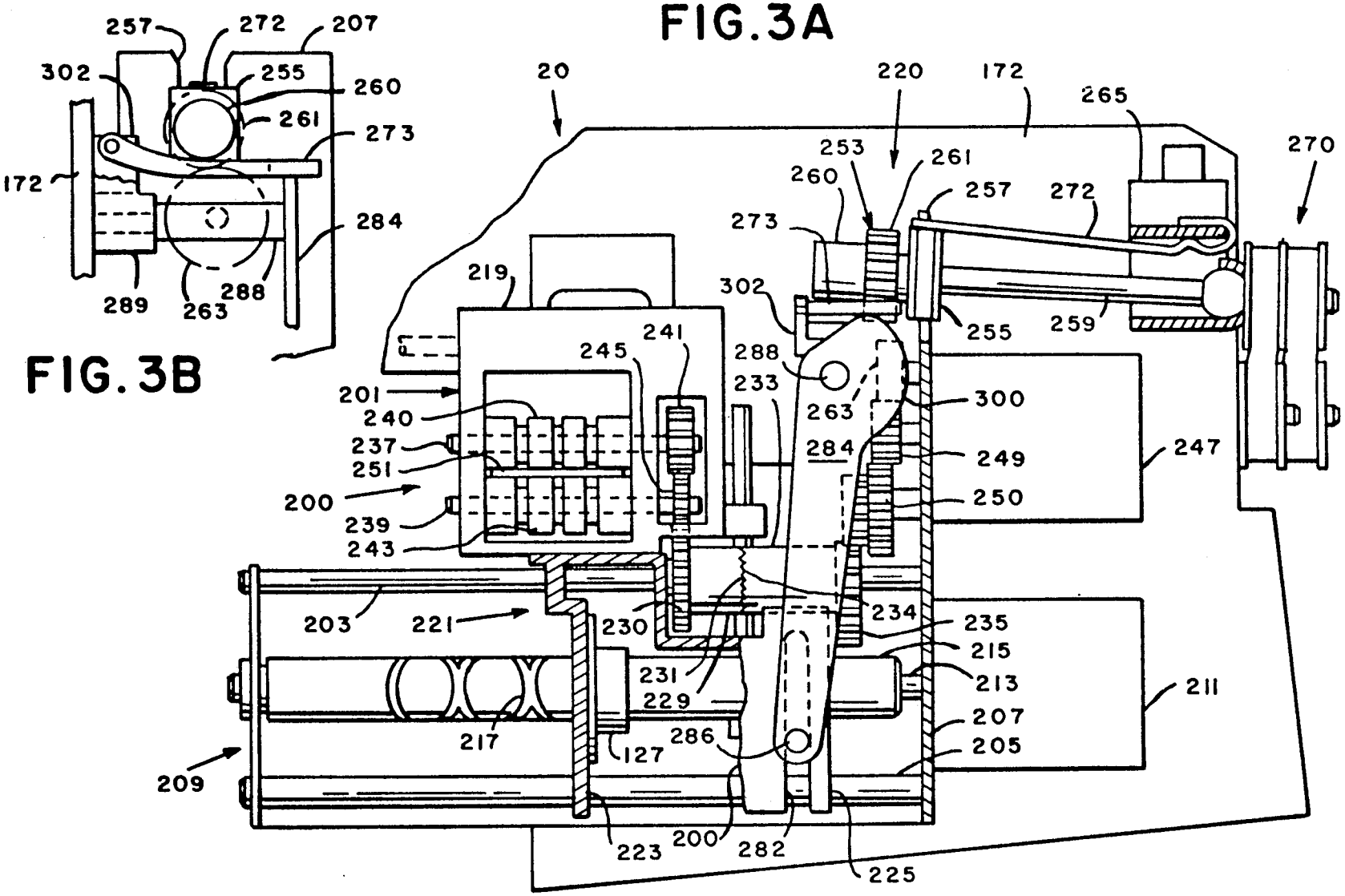

Referring to FIGS. 2 and 3A, the mailing machine (not shown) which houses the postage meter 20 includes a tape dispensing assembly 200 comprised of a tape feed carriage assembly 201. The tape feed carriage assembly 201 is slidably supported on rails 203 and 205 respectively. The rails 203 and 205 are fixably mounted respectively at one end to mailing machine support wall 207 and at their other end to support wall 209. A first drive motor 211 is fixably mounted to the support wall 207 having an output shaft 213 coupled to one end of a cam rod 215. The cam rod 215 includes a form cam track 217. The cam rod 215 is rotatively supported at its other end in support wall 209.

The tape feed carriage assembly 201 includes a frame 219 which is mounted to support linkage 221 which includes vertical support links 223 and 225. The rail 203 extends through aligned apertures in the respective vertical support links 223 and 225 such that the support linkage 221 can be slidably displaced along rail 203 in a manner subsequently described. The cam rod 215 also extends through respectively aligned apertures in support links 223 and 225. A C-recess is formed in the lower end of the respective support links 223 and 225 to extend partially around the support rod rail 205. Then vertical support link 223 has formed herein a cam follower collar 127, of any suitable and conventional construction, around the cam rod 215 such that upon directional rotation of the cam rod 215 by first drive motor 211, the follow (not shown) of the cam collar 127 tracks in the form cam track 217 to cause the tape feed carriage assembly 201 to reciprocally displace laterally along rails 203 and 205 between a home and second position.

Rotatively mounted to the vertical support link 225 around rail 203 by any conventional means is a gear hub 229 having radial gear 230 and axial gear 231. The rail 203 has rotatively mounted therearound by any conventional means a gear hub 233 having axial gear 234 and radial gear 235. The gear hubs 229 and 233 are along the rail 203 such that when the tape feed carriage assembly 201 is in the home position, gears 231 and 234 are brought into engaging contact.

The feed carriage frame 219 rotatively supports a first and second shafts 237 and 239 respectively. Fixably mounted around respective portions of first shaft 237 is a roller 240 and a gear 241. In like manner, a roller 243 and gear 245 are fixably mounted around second shaft 239 such that the rollers 240 and 243 are radially aligned and gears 241 and 245 are in radial meshed engagement.

A second motor 247 having a drive gear 249 is fixably mounted to the support wall 207. A gear set 250 is rotatively mounted to the support wall 207 and provides intermediate communication between gear 249 and 235. It is now apparent that positioning of the carriage assembly 200 in the home position by first drive motor 211 brings gears 231 and 234 into engaging contact. Actuation of second motor 247 can then cause tape 251 to be advanced in a tape track (not shown) supported by the frame 219 by rollers 240 and 243.

Referring additionally to FIG. 3*b*, the drive assembly 220 further includes a gear assembly 253 which includes a slide plate 255 slidably by an conventional means. captured in a slot 257 formed in support wall 207. Rotatively mounted in the slide plate 255 is a shaft 259. At one end of shaft 259 is rotatively mounted a striker hub 260 followed by a fixably mounted gear 261 between the striker hub and the shaft 259. A gear 263 is rotatively mounted to support wall 207 and aligned for meshed engagement with fixably mounted gear 261. A bracket 265 is fixably mounted to wall 172 which pivotally and rotatively supports the shaft 259. Fixably mounted to the other end of the shaft 259 are belt coupler 270 in respective belt communication with couplers 117 (FIG. 2) for driving the driven mechanism 45 (FIG. 2) which displaces the meter cover engaging means. A leaf spring 272 is affixed to the bracket 265 and extends to contact the slide plate 255 for urging the slide plate 255 downwardly in the slot 257. The support link 221 further includes a side plate 280 having an open slot 282 formed therein. One end of a transfer link 284 includes a hub 286 slidably captured in the slot 282 by any conventional means. The second end of transfer link 284 includes a hub 288 which is pivotally mounted in a collar 289 by any conventional means. The collar 289 is fixably mounted to the wall 172. The second end of the transfer link 284 is eccentrically shaped to form a cam surface 300. A bracket 302 s fixably mounted to wall 172 and pivotally supports one end of a striker 273. The striker 273 extends below the striker hub 260 and further along the cam surface 300 of the transfer link 284. It can now be appreciated that carriage assembly 201 is in the home position, the striker 273 is brought into forced engagement with the striker hub 260 by pivotal displacement of transfer link 284 resulting in disengagement of gear 261 from gear 263. In this case, the second motor 247 is employed to drive the tape feed carriage assembly 201. When the tape feed carriage assembly 201 is in the second position, the spring 272 forces gears 261 into engagement with gear 263. The second motor 247 can then be used to drive the drive mechanism 45 (FIG. 5) for the meter cover engaging means (partially shown in phantom).

Certain changes in modifications of embodiments of the invention herein disclosed will be readily apparent to those skilled in the art. Moreover, uses of the invention other than in postage meters and mailing machines will also be readily apparent to those with skill in the art. It is the applicants' intention to cover by the claims all such uses and all such changes and modifications which could be made to the embodiments of the inventions herein chosen for the purpose of disclosure which do not depart from the spirit and scope of the invention.

What is claimed is:

1. An improved coupler means in combination with a mailing machine base having a postage meter insertable and removably from a receptacle means, said receptacle means being mounted within a base and having meter looking device for locking said postage meter in said receptacle means responsive to a lock engagement means, a tape feed assembly having first drive means for positioning said tape feed assembly in a first location and a second location, and second driven means for motivating said tape feed assembly, and coupler means for coupling said second drive means to said lock engagement means only when said tape feed assembly is in said first location, wherein the improvement comprises:

said lock engagement means having gear engagement means for providing driving engagement of said second drive means in a first location and for providing disengagement of said second drive means in a second location;

lever means for selectively positioning said gear engagement means in said first and second locations;

link transfer means coupled to said tape feed assembly for translating lateral displacement of said tape feed assembly to rotational displacement of a cam surface, said lever means to a position said gear engagement means in response to rotational displacement of said cam surface.

2. An improved coupler means as claimed in claim 1 wherein said link transfer means comprises a link having a cam surface formed at a first end, said link having a second end slidably mounted to said tape feed assembly such that linear displacement of said tape feed assembly causes said link to pivot, said lever means being operatively coupled to said cam surface to vertically displace a striker in response to pivotal displacement of said cam surface.

* * * * *